US005913443A

United States Patent [19]

Matthews-Guest

[11] Patent Number: 5,913,443

[45] Date of Patent: Jun. 22, 1999

[54] LUNCH CONTAINER LINER

[76] Inventor: Bedar Matthews-Guest, P.O. Box 362, Inverness, Calif. 94937

[21] Appl. No.: 08/984,914

[22] Filed: Dec. 4, 1997

[51] Int. Cl.[6] ..... B65D 25/00

[52] U.S. Cl. ..... 220/495.03; 229/122.31

[58] Field of Search ..... 220/495.01, 495.02, 220/495.03, 495.08, 495.11; 229/122.3, 122.31, 122.34, 122.27

[56] References Cited

U.S. PATENT DOCUMENTS

| | | | |
|---|---|---|---|
| 1,150,076 | 8/1915 | Stokes | 229/122.31 X |
| 2,260,230 | 10/1941 | Olson | 220/495.03 X |
| 2,287,495 | 6/1942 | Moyers | 220/495.03 |
| 2,822,972 | 2/1958 | Hartley | 229/122.31 |
| 2,873,060 | 2/1959 | Inman | 220/495.03 X |
| 3,187,976 | 6/1965 | Struble | 229/122.3 X |
| 3,828,966 | 8/1974 | Martin | 220/495.03 X |
| 5,411,165 | 5/1995 | Ellis | 220/495.08 |

*Primary Examiner*—Steven Pollard
*Attorney, Agent, or Firm*—Limbach & Limbach L.L.P.

[57] ABSTRACT

A disposable lunch container liner to protect the interior of a lunch container from food particles. The lunch container liner has adhesive pieces on its under side for removable attachment to the interior of a lunch container.

9 Claims, 2 Drawing Sheets

LUNCH CONTAINER LINER

FIELD OF THE INVENTION

The present invention relates to a disposable lunch container liner, which keeps the interior of a lunch container clean and free of food particles. The invention is a liner that may be easily inserted to protect the interior of a lunch container. Similarly, the liner also may be easily removed from the lunch container for disposal.

BACKGROUND OF THE INVENTION

Many children bring their lunch to school in a container such as a lunch box. Often, the lunch box that they bring home is soiled with food crumbs or spills because there is no protection between the lunch contents in the container and the interior of the container. Many parents find it difficult and time consuming to clean the interior of a dirty lunch box.

The present invention discloses a non-porous disposable lunch container liner that protects the interior of a lunch container from being soiled by food spills and crumbs.

SUMMARY OF THE INVENTION

The present invention is a lunch container liner that separates the interior of a lunch container from the food contents in the container. The liner is made of a non-porous material to protect the interior of the lunch container from being soiled by the food in the container. The liner is designed to conform to a food container of any shape and to cover all interior surfaces of the container, except the interior surface of the cover of the container. The liner is equipped with adhesive strips to hold the liner in place once it is inserted into the lunch container.

The adhesive strips permit easy insertion into and removal from a lunch container. After the liner is used in a lunch container, it may be removed and discarded. If a lunch container is used in conjunction with the invention, the interior of the lunch container remains clean and free of spills and crumbs.

BRIEF DESCRIPTION OF THE DRAWINGS

The invention will be better understood by reference to the attached figures in which.

DETAILED DESCRIPTION OF THE PREFERRED EMBODIMENTS

Figure 1:
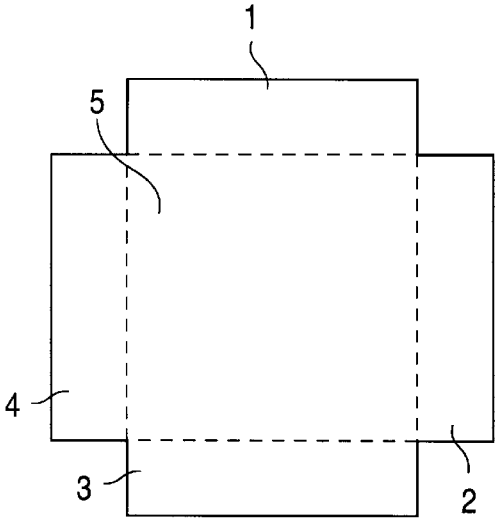
FIG. 1 is a plan view of the top side of a preferred embodiment in an unfolded state.
Figure 2:
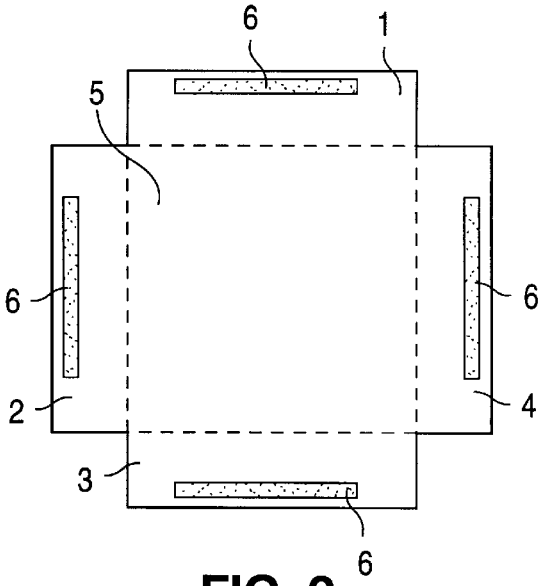
FIG. 2 is a plan view of the under side of a preferred embodiment in an unfolded state.

An embodiment of the invention will be described with reference to FIGS. 1–4. With reference to FIGS. 1–4, the invention includes a first side piece 1, a second side piece 2, a third side piece 3, a fourth side piece 4, and a base 5. As shown in FIGS. 1 and 2, the base 5 is attached to each side piece 1, 2, 3, 4. The base 5 and the four side pieces 1, 2, 3, 4 are made of a single piece of continuous material.

As shown in FIGS. 1 and 2, the invention is in a flat, unfolded state. FIG. 1 is a plan view of the top side of the invention in a flat, unfolded state. The top side is the side that is exposed to the lunch contents once the liner is inserted into the lunch container.

FIG. 2 is a plan view of the under side of the invention in a flat, unfolded state. An adhesive strip 6 is located on the under side of each side piece 1, 2, 3, 4 of the liner to affix the liner to the interior of the lunch container.

Figure 3:
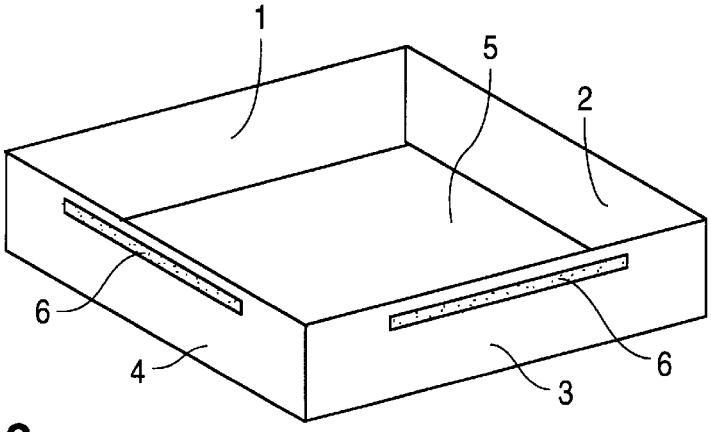
FIG. 3 is a side view of a preferred embodiment in a folded state.
Figure 4:
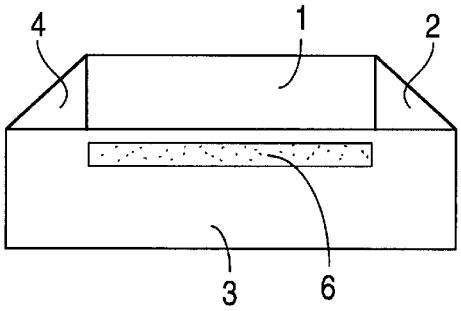
FIG. 4 is a front plan view of a preferred embodiment in a folded state.

FIGS. 3 and 4 show the invention in a folded state, as it would be inserted in a lunch container. In FIGS. 3 and 4, the adhesive strips 6 are affixed to the under side of the liner for contact with the interior of a lunch container.

In one embodiment, the liner is made of a heavy duty material that is quilted and absorbent on one side and non-porous on the other side. The non-porous side is inserted into the lunch container so that it is adjacent the interior of the lunch container. The quilted side would be the top side of the liner, as shown in FIG. 1. The quilted, absorbent side is exposed to the lunch contents to absorb spills. The non-porous material can be selected from, for example, paper (including cardboard or so-called wax-paper) or plastic.

In other embodiments of the invention, the liner may conform to lunch containers of various shapes and sizes. The liner is designed to cover all interior surfaces of a container except for the interior surface of the cover of the container. In the embodiment shown in FIGS. 1–4, the liner is designed to conform to a container having a square base. In another embodiment, the liner may be designed to conform to a container having a rectangular base.

Figure 5:
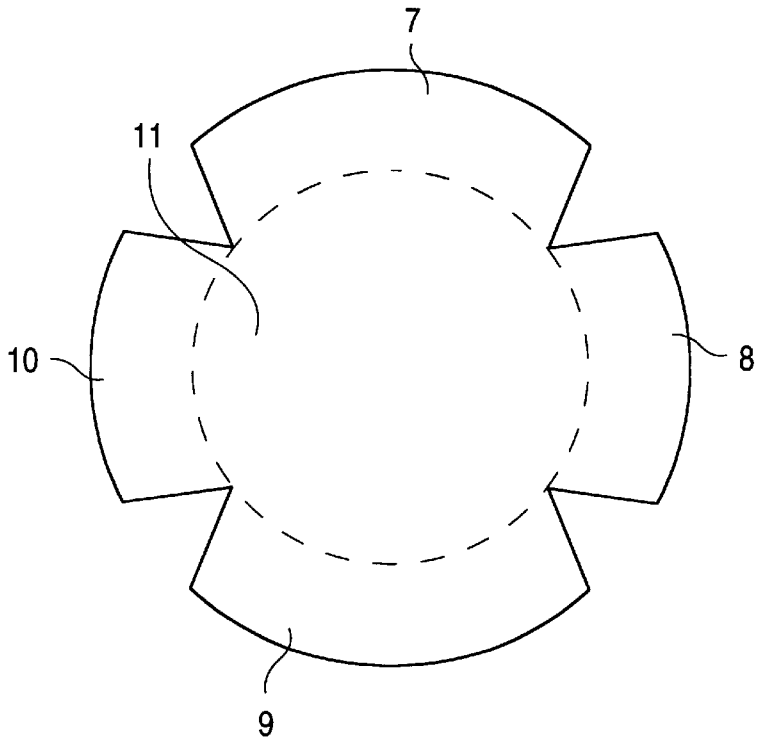
FIG. 5 is a plan view of the top side of an alternate embodiment in an unfolded state.
Figure 6:
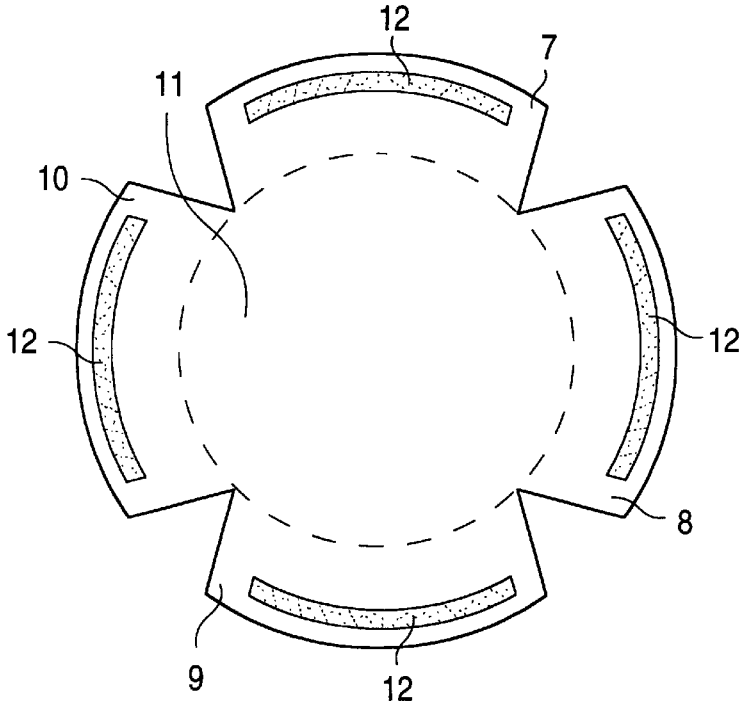
FIG. 6 is a plan view of the under side of an alternate embodiment in an unfolded state.

In an embodiment shown in FIGS. 5 and 6, the liner is designed to conform to a container having a circular base. In FIGS. 5 and 6, the invention includes a first side piece 7, a second side piece 8, a third side piece 9, a fourth side piece 10, and a base 11. As shown in FIGS. 5 and 6, the base 11 is attached to each side piece 7, 8, 9, 10. The base 11 and the four side pieces 7, 8, 9, 10 are made of a single piece of continuous material. In FIG. 6, adhesive strips 12 are affixed to the side pieces 7, 8, 9, 10.

What is claimed is:

1. A liner for protection of a food container, comprising:

a single continuous piece of non-porous material that conforms to a food container, said piece shaped to simultaneously completely cover an interior bottom surface of the food container and all interior side surfaces of the container; and at least one adhesive piece affixed on at least one side of the material for removable attachment and sealing of the material to the container, the adhesive piece having a length substantially equal to that of the side of the material on which the adhesive piece is affixed.

2. The liner of claim 1 wherein the single continuous piece of non-porous material has an absorbent side.

3. The liner of claim 1 wherein the single continuous piece of non-porous material is a flexible material.

4. A liner for protection of a food container, comprising:

a single continuous piece of material in a shape of a square having a rectangular piece with a length equal to a length of the square attached to each side of the square; and an adhesive located on at least one side of each rectangular piece for removable attachment and sealing of the material to the container, the adhesive having a length substantially equal to that of the side of the rectangular piece on which the adhesive piece is affixed.

5. The liner of claim 4 wherein the single continuous piece of non-porous material has an absorbent side.

6. The liner of claim 4 wherein the single continuous piece of non-porous material is a flexible material.

7. A food container and liner combination for protection of a food container, comprising:

a food container;

a single continuous piece of non-porous material that conforms to the food container of any shape and covers an interior bottom surface of the food container and all interior side surfaces of the container; and at least one adhesive piece removably affixing and sealing said non-porous material to said container, the adhesive piece having a length substantially equal to that of a perimeter of the material.

8. The liner of claim 7 wherein the single continuous piece of non-porous material has a quilted and absorbent side.

9. The liner of claim 7 wherein the single continuous piece of non-porous material is a flexible material.

* * * * *